US007358907B2

(12) United States Patent
Takaba et al.

(10) Patent No.: US 7,358,907 B2
(45) Date of Patent: Apr. 15, 2008

(54) SMALL-SIZED ANTENNA

(75) Inventors: Shinichi Takaba, Hitachi (JP); Makoto Usui, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 314 days.

(21) Appl. No.: 11/077,158

(22) Filed: Mar. 11, 2005

(65) Prior Publication Data

US 2006/0097928 A1 May 11, 2006

(30) Foreign Application Priority Data

Nov. 5, 2004 (JP) ..... 2004-321925

(51) Int. Cl.
*H01Q 1/24* (2006.01)

(52) U.S. Cl. ..... 343/702

(58) Field of Classification Search ..... 343/702, 343/700 MS, 829, 841, 846
See application file for complete search history.

(56) References Cited

U.S. PATENT DOCUMENTS

| | | | | |
|---|---|---|---|---|
| 5,856,912 | A * | 1/1999 | Miller et al. | 361/737 |
| 6,040,803 | A * | 3/2000 | Spall | 343/700 MS |
| 6,110,576 | A * | 8/2000 | Decker et al. | 428/300.1 |
| 6,333,716 | B1 * | 12/2001 | Pontoppidan | 343/702 |
| 2004/0029329 | A1 * | 2/2004 | Borghs et al. | 438/167 |

FOREIGN PATENT DOCUMENTS

| | | |
|---|---|---|
| JP | 7-288422 | 10/1995 |
| JP | 2002-299934 | 10/2002 |

* cited by examiner

*Primary Examiner*—Huedung Mancuso
(74) *Attorney, Agent, or Firm*—McGinn IP Law Group, PLLC

(57) ABSTRACT

A small-sized antenna is adapted to be mounted on a circuit substrate. The antenna has an antenna body and a resin-molded body that has a first resin-molded body and a second resin-molded body. The antenna body is sandwiched by the first and second resin-molded bodies. The first resin-molded body engages to the second resin-molded body, and the first resin-molded body is mounted on the circuit substrate.

14 Claims, 5 Drawing Sheets

11:ANTENNA BODY

12:FIRST RESIN-MOLDED BODY

13:SECOND RESIN-MOLDED BODY

50:CIRCUIT SUBSTRATE

50g:GROUND PLANE

54:POSITIONING HOLE

11:ANTENNA BODY

12:FIRST RESIN-MOLDED BODY

13:SECOND RESIN-MOLDED BODY

50:CIRCUIT SUBSTRATE

50g:GROUND PLANE

54:POSITIONING HOLE

15:INVERTED-F ANTENNA ELEMENT

16:GROUND PIECE

17:POWER FEED PIECE

20:POWER FEED TERMINAL

30:ENGAGING HOLE

44:ENGAGING PIECE

12:FIRST RESIN-MOLDED BODY

23:ENGAGING PIECE

24:STOPPER PIECE

33:ENGAGING GROOVE

34:RECESSED GROOVE

35:MOUNTING SURFACE

36:BOSS

13:SECOND RESIN-MOLDED BODY

40:HOUSING GROOVE 41,42:COVERING PIECE

43:NOTCHED PORTION

44:ENGAGING PIECE

45:HOLE

11:ANTENNA BODY

15:INVERTED-F ANTENNA ELEMENT

16:GROUND PIECE

17:POWER FEED PIECE

18:HOLE

19:GROUND TERMINAL

20:POWER FEED TERMINAL

21:UPRIGHT ANTENNA PIECE

22:HORIZONTAL ANTENNA PIECE

23:ENGAGING PIECE

24:STOPPER PIECE 1a-1d:FOLD LINE

21b:UPRIGHT ELEMENT PORTION

16:GROUND PIECE

21:UPRIGHT ANTENNA PIECE

22:HORIZONTAL ANTENNA PIECE

12:FIRST RESIN-MOLDED BODY

30:ENGAGING HOLE

34:RECESSED GROOVE

35:MOUNTING SURFACE

35a:TIP SIDE PORTION 31,32:STAGE PORTION

SMALL-SIZED ANTENNA

The present application is based on Japanese patent application No. 2004-321925, the entire contents of which are incorporated herein by reference.

BACKGROUND OF THE INVENTION

1. Field of the Invention

The present invention relates to a small-sized antenna which is integrated into mobile devices, and the like.

2. Description of the Related Art

As next-generation wireless data communication technology, Bluetooth which uses a band of 2.4 GHz that can be used without a license has been in the limelight, and is integrated into mobile devices such as mobile phones, notebook PCs, PDAs (Personal Digital Assistances), etc., and is expected to become increasingly common.

Circuit components such as antennas, wireless modules, etc., used in the Bluetooth are required to be reduced in size and weight, and it is important to be small in the area occupied by an antenna to be mounted on a circuit.

Although, as a small-sized antenna for this Bluetooth, an inverted-F monopole antenna, or the like has been developed, it is very small (for example, 20 mm×3 mm×3 mm), so that, to mount it on a circuit substrate, a metal conductor which serves as an antenna has to be mounted by integrating it with a resin-molded body (e.g. see Japanese patent application laid-open Nos. 2002-299934 and 7-288422).

However, since, as mentioned above, the small-sized antenna for Bluetooth is very small (about 20 mm×3 mm×3 mm), and is resin-molded together with the metal conductor, sealing of the metal conductor and mold, and the like is required, and there is therefore the problem that the mold tends to be costly.

In particular, as small-sized antennas of this kind tend to be often improved in their shape, changing the mold accordingly would be more costly.

SUMMARY OF THE INVENTION

It is an object of the present invention to provide a structure of small-sized antenna that the manufacturing cost can be reduced.

(1) According to one aspect of the invention, a small-sized antenna for being mounted on a circuit substrate comprises:

an antenna body; and a resin-molded body that comprises a first resin-molded body and a second resin-molded body, wherein the antenna body is sandwiched by the first and second resin-molded bodies, the first resin-molded body engages to the second resin-molded body, and the first resin-molded body is adapted to be mounted on the circuit substrate.

(2) According to another aspect of the invention, a small-sized antenna for being mounted on a circuit substrate comprises:

an antenna body; and a resin-molded body that comprises a first resin-molded body and a second resin-molded body, wherein the antenna body is sandwiched by the first and second resin-molded bodies, the first resin-molded body engages to the second resin-molded body, the first resin-molded body is adapted to be mounted on the circuit substrate, the antenna body comprises a ground piece to be seated on the circuit substrate, and an inverted-F antenna element that rises upright from the ground piece and extends parallel to the circuit substrate, the inverted-F antenna element comprising a power feed piece.

It is preferred that the first and second resin-molded bodies sandwich part of the inverted-F antenna element situated nearer its tip side in relation to the power feed piece.

(3) According to another aspect of the invention, a small-sized antenna for being mounted on a circuit substrate comprises:

an antenna body; and a resin-molded body that comprises a first resin-molded body and a second resin-molded body, wherein the antenna body is sandwiched by the first and second resin-molded bodies, the first resin-molded body engages to the second resin-molded body, the first resin-molded body is adapted to be mounted on the circuit substrate, the antenna body comprises an inverted-F antenna element that is formed in a cross-sectional L shape, the inverted-F antenna element comprising an engaging piece, the first resin-molded body is formed substantially in a rectangular parallelepiped shape, the first resin-molded body comprising a top edge portion to contact the inverted-F antenna element and an engaging groove to engage to the engaging piece of the inverted-F antenna element, and the second resin-molded body is formed substantially in a plate shape to cover the first resin-molded body while sandwiching the inverted-F antenna element therebetween, the second resin-molded body comprising an engaging piece to engage to an engaging hole of the first resin-molded body.

It is preferred that the first resin-molded body comprises on its back side a protruded boss to be fitted into a positioning hole of the circuit substrate.

It is preferred that the ground piece comprises a hole for attaching the small-sized antenna to the circuit substrate.

It is preferred that the ground piece comprises a ground terminal folded downward, the power feed piece comprises a power feed terminal folded downward, and the ground terminal and the power feed terminal are adapted to be connected through a through-hole provided in the circuit substrate to a power supply circuit.

<Advantages of the Invention>

In the invention, the first and second resin-molded bodies engage to each other while sandwiching the antenna body therebetween and, in which state, the antenna body is mounted on the circuit substrate. Thus, the first and second resin-molded bodies can be each made by molding etc. without incorporating the antenna body. For this reason, the manufacturing cost can be reduced.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
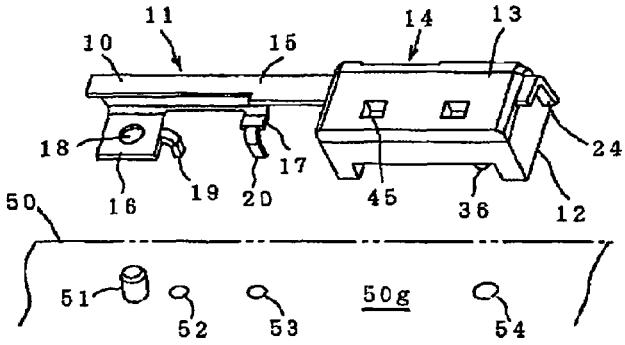
FIG. 1 illustrates one embodiment of a small-sized antenna according to the present invention, illustrating a perspective view of a state where the small-sized antenna is to be mounted onto a circuit substrate.
Figure 2:
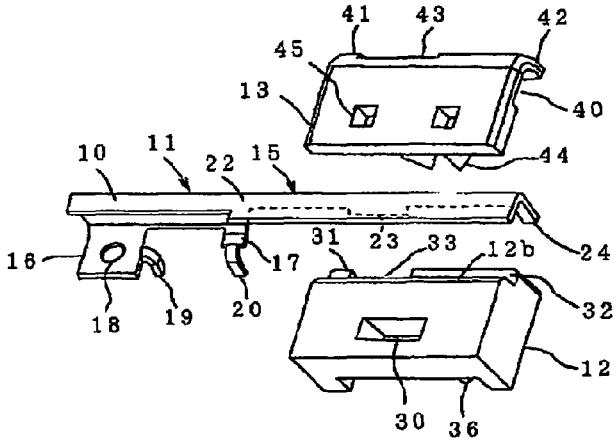
FIG. 2 illustrates a perspective view of a state of assembling a metal conductor and a resin-molded body in the small-sized antenna of FIG. 1.
Figure 3:
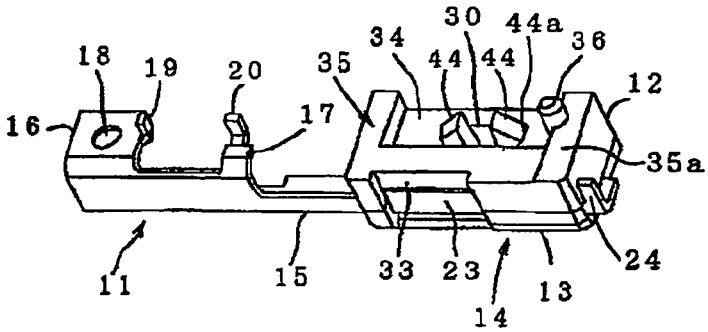
FIG. 3 illustrates a perspective view where the small-sized antenna illustrated in FIG. 1 is reversed.
Figure 5A:
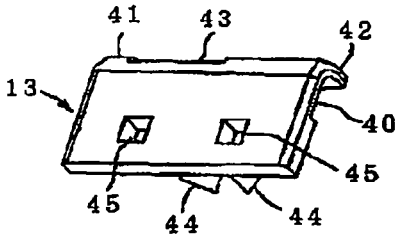
FIGS. 5A-5B illustrate a perspective view of a second resin-molded body in the small-sized antenna illustrated in FIG.1.
Figure 5B:
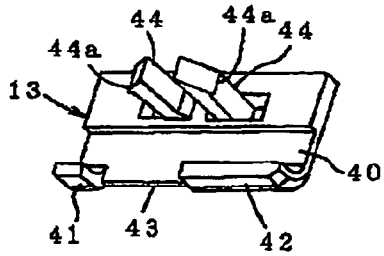
Figure 4A:
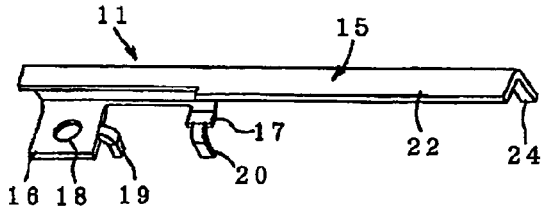
FIGS. 4A-4D illustrate perspective and development views of the metal conductor in the small-sized antenna illustrated in FIG.1.
Figure 4B:
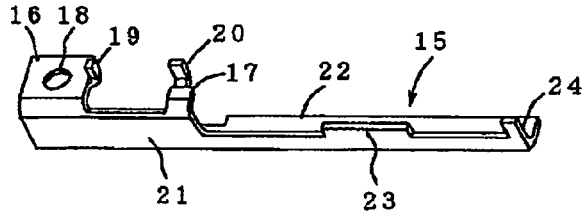
Figure 4C:
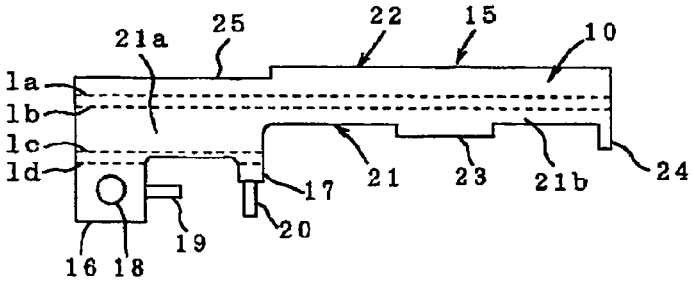
Figure 4D:
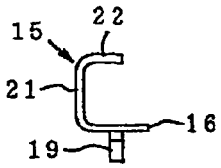
Figure 6A:
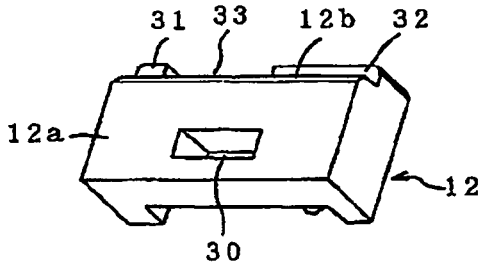
FIGS. 6A-6C illustrate a perspective view of a first resin-molded body in the small-sized antenna illustrated in FIG.1.
Figure 6B:
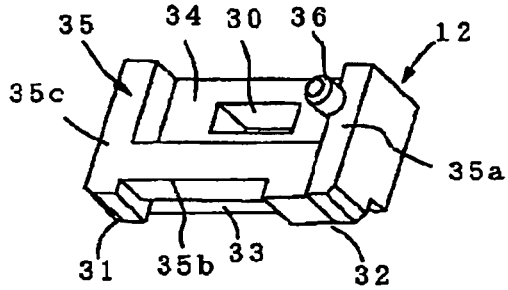
Figure 6C:
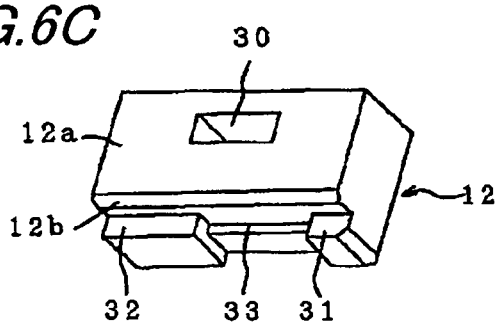

FIGS. 1-6 illustrate one embodiment of a small-sized antenna according to the present invention. FIG. 1 illustrates a perspective view of a state where the small-sized antenna is to be mounted onto a circuit substrate. FIG. 2 illustrates a perspective view of a state of assembling a metal conductor and a resin-molded body in the small-sized antenna. FIG. 3 illustrates a perspective view where the small-sized antenna illustrated in FIG. 1 is reversed. FIG. 4 illustrates perspective and development views of the metal conductor in the small-sized antenna. FIG. 5 illustrates a perspective view of a second resin-molded body in the small-sized antenna. FIG. 6 illustrates a perspective view of a first resin-molded body in the small-sized antenna.

As in illustrated in FIG. 1-3, the small-sized antenna of the invention comprises an antenna body 11 formed of a metal conductor 10, and a resin-molded body 14 consisting of first and second resin-molded bodies 12 and 13 for sandwiching that antenna body 11 therebetween for mounting the antenna body 11 on a circuit substrate 50.

This antenna body 11, and the first and second resin-molded bodies 12 and 13 constituting the resin-molded body 14 is explained below.

FIG. 4(*a*) illustrates a perspective view of the antenna body 11; FIG. 4(*b*) illustrates a perspective view of a state where the antenna body 11 illustrated in FIG. 4(*a*) is reversed; FIG. 4(*c*) illustrates a development view of the metal conductor 10 before the antenna body 11 is formed; and FIG. 4 (*d*) illustrates the left side view of FIG. 4(*a*).

As illustrated in FIG. 4 (*c*), the antenna body 11 is formed of the metal conductor 10 formed by die-cutting of a metal plate (0.3 mm thick) of e.g., phosphor bronze with a press, followed by folding thereof, as illustrated.

The metal conductor 10 has an inverted-F antenna element 15 formed by being folded in an L shape along fold lines 1*a* and 1*b*, a ground piece 16 formed by being folded along fold lines 1*c* and 1*d* in an end portion of that inverted-F antenna element 15, and a power feed piece 17 formed by being likewise folded along fold lines 1*c* and 1*d* on the tip side of the inverted-F antenna element 15 relative to the ground piece 16.

The ground piece 16 has a hole 18 formed for engaging a boss 51 of the circuit substrate 50 (see FIG. 1) or for a screw being fastened to the circuit substrate 50, and a ground terminal 19 formed by being folded for being inserted and soldered into a through hole 52 of the circuit substrate 50 (see FIG. 1).

The power feed piece 17 has a power feed terminal 20 formed by being folded for being inserted and soldered into a through hole 53 of the circuit substrate 50 (see FIG. 1).

The inverted-F antenna element 15 comprises an upright antenna piece 21 caused to rise upright by being folded along fold lines 1*c* and 1*d* from the ground piece 16 and the power feed piece 17, and a horizontal antenna piece 22 folded horizontally above the ground piece 16 and the power feed piece 17 along fold lines 1*a* and 1*b* from that upright antenna piece 21.

The upright antenna piece 21 comprises a base portion 21*a* positioned in the ground piece 16 and the power feed piece 17, and an upright element portion 21*b* extending directly from the base portion 21*a* so as to be formed in a more elongated shape than the base portion 21*a* and caused to float up from a ground plane 50*g* of the circuit substrate 50 (see FIG. 1). This upright element portion 21*b* is provided with an engaging piece 23 and a stopper piece 24 which engage the resin-molded body 14.

The horizontal antenna piece 22 has a notched portion 25 positioned on the side of the ground piece 16 and the power feed piece 17.

The antenna body 11 is formed in such a way that, for example, the length of the inverted-F antenna element 15 is 21.6 mm; the width of the tip of the inverted-F antenna element 15 is 1.85 mm; and the height from the ground piece 16 to the horizontal antenna piece 22 is 3 mm.

Referring to FIGS. 5 and 6 next, the first and second resin-molded bodies 12 and 13 constituting the resin-molded body 14 is explained.

FIG. 5(*a*) illustrates a perspective view of the second resin-molded body 13; and FIG. 5(*b*) illustrates a perspective view where the second resin-molded body 13 illustrated in FIG. 5(*a*) is reversed. FIG. 6(*a*) illustrates a perspective view of the first resin-molded body 12; FIG. 6(*b*) illustrates a perspective view where the first resin-molded body 12 illustrated in FIG. 6(*a*) is reversed; and FIG. 6(*c*) illustrates a perspective view where the first resin-molded body 12 illustrated in FIG. 6(*a*) is viewed from the back side.

As illustrated in FIG. 6(*a*), the first resin-molded body 12 is formed in a substantially rectangular parallelepiped shape (e.g., 9 mm long, 4.5 mm wide, 2.7 mm high), and has a rectangular engaging hole 30 formed in a top face 12*a*; a top edge portion 12*b* formed so as to come into contact with the internal surface side of the L-shaped inverted-F antenna element 15 of the antenna body 11; stage portions 31 and 32 formed on a top side face so as to come into contact with the upright element portion 21*b* of the inverted-F antenna element 15; and an engaging groove 33 formed between the stage portions 31 and 32 so as to engage the engaging piece 23 of the inverted-F antenna element 15.

As illustrated in FIG. 6(*b*), the first resin-molded body 12 has a recessed groove 34 formed in its back face, and a U-shaped mounting surface 35 which is mounted on the circuit substrate 50 (see FIG. 1) is formed around the recessed groove 34. A tip side portion 35*a* of this mounting surface 35 which is on the tip side of the inverted-F antenna element 15 is made slightly higher (the order of 0.1 mm) than other front side portion 35*b* and back end side portion 35*c*, thereby allowing the ground piece 16 and the power feed piece 17 of the antenna body 11 to be securely mounted on the circuit substrate 50.

A boss 36 which is positioned in the tip side portion 35*a* of the mounting surface 35 and the recessed groove 34 to be fitted into a positioning hole 54 of the circuit substrate 50 is formed so as to protrude from the mounting surface 35.

As illustrated in FIGS. 5(*a*)and 5(*b*), the second resin-molded body 13 is formed in a plate shape (e.g., 0.8 mm thick), and has a housing groove 40 formed in its back face so as to come into contact with the external surface side of the L-shaped inverted-F antenna element 15 of the antenna body 11; covering pieces 41 and 42 formed on the front edge side so as to come into contact with the stage portions 31 and 32 of the first resin-molded body 12 with the inverted-F antenna element 15 sandwiched therebetween; and a notched portion 43 formed between the covering pieces 41 and 42 so as to cause the engaging piece 23 of the inverted-F antenna element 15 to open.

A pair of engaging pieces 44, 44 which engages the engaging hole 30 of the first resin-molded body 12 is formed in the back face of the second resin-molded body 13 which comes into contact with the top face 12*a* of the first resin-molded body 12. The engaging pieces 44, 44 has a hook portion 44*a* formed so as to engage a surface of the recessed groove 34 of the first resin-molded body 12 after being inserted into the engaging hole 30. The second resin-molded body 13 has holes 45, 45 cut in positions of both sides of the engaging pieces 44, 44, which are for handling for sandwiching the antenna body 11 between the first and second resin-molded body 12 and 13 for fitting the antenna body 11 therebetween.

FIGS. 1-3 illustrate states where the antenna body 11 and the resin-molded body 14 consisting of first and second resin-molded bodies 12 and 13 are assembled.

As illustrated in FIG. 2, the inverted-F antenna element 15 of the antenna body 11 is brought into contact with the top edge portion 12*b* of the first resin-molded body 12; as illustrated in FIG. 3, the engaging piece 23 is caused to engage the engaging groove 33 of the first resin-molded body 12, while the stopper piece 24 is brought into contact with a side face of the stage portion 32 of the first resin-molded body 12; and in that state, the second resin-molded body 13 is fitted over the first resin-molded body 12 and the engaging piece 44 is fitted into the engaging hole 30 of the first resin-molded body 12, thereby causing the hook portion 44*a* of the engaging piece 44 to engage the surface of the recessed groove 34 so as to combine the second resin-molded body 13 with the first resin-molded body 12 with the antenna body 11 sandwiched therebetween, allowing the antenna body 11 to be held by the resin-molded body 14.

When this small-sized antenna is mounted on the circuit substrate 50, the boss 36 of the resin-molded body 14 is inserted into the positioning hole 54 of the circuit substrate 50, and the hole 18 of the ground piece 16 of the antenna body 11 is fitted onto the boss 51 of the circuit substrate 50, thereby allowing the small-sized antenna to be mounted on the circuit substrate 50. In this case, since the tip side portion 35*a* of the mounting surface 35 of the first resin-molded body 12 which is on the tip side of the antenna body 11 is made slightly higher, the ground piece 16 and the power feed piece 17 of the antenna body 11 can be securely brought into contact with the circuit substrate 50.

Also, the ground terminal 19 of the ground piece 16 and the power feed terminal 20 of the power feed piece 17 are inserted into the through holes 52 and 53 of the circuit substrate 50 for being soldered from the back side of the circuit substrate 50 for being connected to a power supply circuit (not illustrated).

In this manner, in the invention, when the antenna body 11 is held by the resin-molded body 14, the resin-molded body 14 is formed by the first and second resin-molded bodies 12 and 13, and the antenna body 11 is sandwiched between the first and second resin-molded bodies 12 and 13 for holding it by the engagement of both. This allows obviating the conventional need to integrally mold the antenna and the resin, but only using a mold for molding the first and second resin-molded bodies 12 and 13, so that the cost of the mold can thereby be substantially reduced, while freely responding even to modifications of antenna design.

Figure 7A:
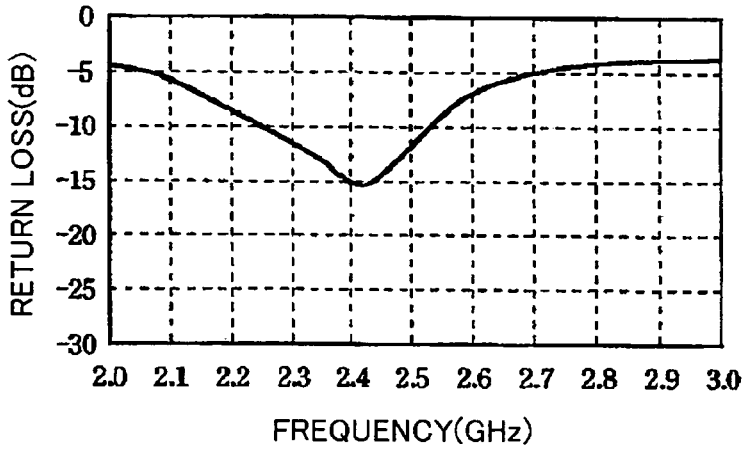
FIGS. 7A-7C show antenna characteristics of a small-sized antenna of the present invention.
Figure 7B:
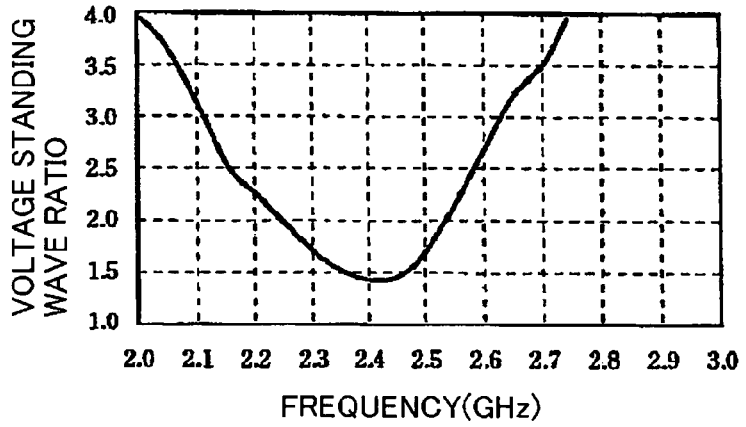
Figure 7C:
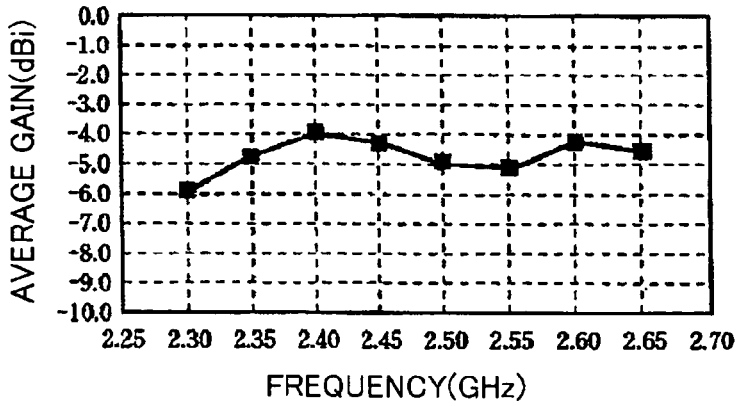

FIG. 7 shows characteristics of a small-sized antenna of the present invention. FIG. 7(*a*) shows the relationship between the frequency and the return loss; FIG. 7(*b*) shows the relationship between the frequency and the voltage standing wave ratio; and FIG. 7(*c*) shows average gain characteristics. Good antenna characteristics have been obtained for a 2.4 GHz band: the return loss is −15 dB; the voltage standing wave ratio is 1.5; and the average gain is −4.0 dBi.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A small-sized antenna for being mounted on a circuit substrate, comprising:

an antenna body; and a resin-molded body that comprises a first resin-molded body and a second resin-molded body, wherein the antenna body is held in place by an engagement of the first and second resin-molded bodies, the first resin-molded body engages to the second resin-molded body, and the first resin-molded body is adapted to be mounted on the circuit substrate.

2. The small-sized antenna according to claim 1, wherein:

the first resin-molded body comprises on its back side a protruded boss to be fitted into a positioning hole of the circuit substrate.

3. The small-sized antenna according to claim 1, wherein:

the first and second resin-molded bodies sandwich only a part of the antenna body.

4. The small-sized antenna according to claim 1, wherein:

at least one of the first and second resin-molded bodies comprises a groove to bold the antenna body.

5. The small-sized antenna according to claim 1, wherein:

the antenna body comprises a folded metal plate.

6. A small-sized antenna for being mounted on a circuit substrate, comprising:

an antenna body; and a resin-molded body that comprises a first resin-molded body and a second resin-molded body, wherein the antenna body is held in place by an engagement of the first and second resin-molded bodies, the first resin-molded body engages to the second resin-molded body, the first resin-molded body is adapted to be mounted on the circuit substrate, the antenna body comprises a round piece to be seated on the circuit substrate, and an inverted-F antenna element that rises upright from the pound piece and extends parallel to the circuit substrate, the inverted-F antenna element comprising a power feed piece.

7. The small-sized antenna according to claim 6, wherein:

the first and second resin-molded bodies sandwich part of the inverted-F antenna element situated nearer its tip side in relation to the power feed piece.

8. The small-sized antenna according to claim 6, wherein:

the first resin-molded body comprises on its back side a protruded boss to be fitted into a positioning hole of the circuit substrate.

9. The small-sized antenna according to claim 6, wherein:

the ground piece comprises a hole for attaching the small-sized antenna to the circuit substrate.

10. The small-sized antenna according to claim 6, wherein:

the ground piece comprises a ground terminal folded downward, the power feed piece comprises a power feed terminal folded downward, and the ground terminal and the power feed terminal are adapted to be connected through a through-hole provided in the circuit substrate to a power supply circuit.

11. The small-sized antenna according to claim 6, wherein:

at least one of said first and second resin-molded bodies comprises a groove to hold the antenna body.

12. The small-sized antenna according to claim 6, wherein:

the antenna body comprises a folded metal plate.

13. A small-sized antenna for being mounted on a circuit substrate, comprising:

an antenna body; and a resin-molded body that comprises a first resin-molded body and a second resin-molded body, wherein the antenna body is sandwiched by the first and second resin-molded bodies, the first resin-molded body engages to the second resin-molded body, the first resin-molded body is adapted to be mounted on the circuit substrate, the antenna body comprises an inverted-F antenna element that is formed in a cross-sectional L shape, the inverted-F antenna element comprising n engaging piece, the first resin-molded body is formed substantially in a rectangular parallelepiped shape, the first resin-molded body comprising a top edge portion to contact the inverted-F antenna element and an engaging groove to engage to the engaging piece of the inverted-F antenna element, and the second resin-molded body is formed substantially in a plate shape to cover the first resin-molded body while sandwiching the inverted-F antenna element therebetween, the second resin-molded body comprising an engaging piece to engage to an engaging hole of the first resin-molded body.

14. The small-sized antenna according to claim 13, wherein:

the first resin-molded body comprises on its back side a protruded boss to be fined into a positioning hole of the circuit substrate.

* * * * *